US009627754B2

(12) United States Patent
Na

(10) Patent No.: US 9,627,754 B2
(45) Date of Patent: Apr. 18, 2017

(54) MOBILE TERMINAL HAVING ANTENNA WITH TWO CONDUCTIVE MEMBERS

(71) Applicant: LG ELECTRONICS INC., Seoul (KR)

(72) Inventor: Youngsoo Na, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 291 days.

(21) Appl. No.: 14/023,132

(22) Filed: Sep. 10, 2013

(65) Prior Publication Data

US 2014/0071022 A1 Mar. 13, 2014

(30) Foreign Application Priority Data

Sep. 11, 2012 (KR) ..... 10-2012-0100608

(51) Int. Cl.

| | |
|---|---|
| ***H01Q 5/00*** | (2015.01) |
| ***H01Q 9/42*** | (2006.01) |
| ***H01Q 5/371*** | (2015.01) |
| *H01Q 1/24* | (2006.01) |
| *H01Q 1/38* | (2006.01) |
| *H01Q 21/28* | (2006.01) |

(52) U.S. Cl.

CPC ..... *H01Q 5/001* (2013.01); *H01Q 5/371* (2015.01); *H01Q 9/42* (2013.01); *H01Q 1/243* (2013.01); *H01Q 1/38* (2013.01); *H01Q 21/28* (2013.01)

(58) Field of Classification Search

CPC ..... H01Q 1/38; H01Q 21/28; H01Q 1/243; G01Q 9/42

USPC ..... 343/702, 904

See application file for complete search history.

(56) References Cited

U.S. PATENT DOCUMENTS

| | | | | |
|---|---|---|---|---|
| 6,498,586 | B2 * | 12/2002 | Pankinaho | H01Q 1/243 343/700 MS |
| 7,301,502 | B2 * | 11/2007 | Sinasi | H01Q 1/243 343/702 |
| 7,642,984 | B2 * | 1/2010 | Tsai | H01Q 1/2266 343/702 |
| 2004/0104853 | A1 * | 6/2004 | Chen | G06F 1/1616 343/702 |
| 2004/0130493 | A1 * | 7/2004 | Horita | H01Q 1/08 343/702 |
| 2004/0252064 | A1 * | 12/2004 | Yuanzhu | H01Q 1/243 343/702 |
| 2005/0270240 | A1 * | 12/2005 | Qi | H01Q 1/243 343/702 |

(Continued)

*Primary Examiner* — Dameon E Levi
*Assistant Examiner* — Ab Salam Alkassim, Jr.
(74) *Attorney, Agent, or Firm* — Birch, Stewart, Kolasch & Birch, LLP

(57) ABSTRACT

A mobile terminal including a terminal body; a display configured to display information; and an antenna device mounted in the terminal body. Further, the antenna device includes a first conductive member including a shape such that the antenna device resonates at a first frequency band; a second conductive member diverging from the first conductive member, and extending by a prescribed length; and a ground member spaced apart from the second conductive member, and capacitive-coupled to the second conductive member, such that a frequency resonance added by the second conductive member is generated near a center frequency of the first frequency band.

18 Claims, 7 Drawing Sheets

(56) References Cited

U.S. PATENT DOCUMENTS

| | | | | |
|---|---|---|---|---|
| 2006/0145923 | A1* | 7/2006 | Autti | H01Q 1/243 343/700 MS |
| 2009/0278750 | A1* | 11/2009 | Man | H04B 1/40 343/702 |
| 2012/0098709 | A1* | 4/2012 | Chun | H01Q 1/243 343/702 |

* cited by examiner

MOBILE TERMINAL HAVING ANTENNA WITH TWO CONDUCTIVE MEMBERS

CROSS-REFERENCE TO A RELATED APPLICATION

Pursuant to 35 U.S.C. §119(a), this application claims the benefit of earlier filing date and right of priority to Korean Application No. 10-2012-0100608, filed on Sep. 11, 2012, the contents of which is incorporated by reference herein in its entirety.

BACKGROUND OF THE INVENTION

Field of the Invention

The present invention relates to a mobile terminal, and particularly, to a mobile terminal having an antenna device capable of transmitting and receiving (transceiving) radio signals.

Background of the Invention

A mobile terminal is a portable electronic device that can be carried anywhere and has at least one function of performing voice and video calls, inputting/outputting information, storing data, etc. As the mobile terminal becomes multifunctional, the mobile terminal can capture still images or moving images, play music or video files, play games, receive broadcast, etc., so as to be implemented as an integrated multimedia player.

Various attempts have been made to implement complicated functions in such a multimedia device using hardware or software. For instance, a user interface (UI) environment, which allows a user to search for or select a function in easier and more convenient manners, is provided.

Besides such attempts, a method for enhancing a function of hardware has been considered. Such method includes structural changes and improvements for allowing a user to conveniently use the mobile terminal. An antenna capable of transmitting and receiving (transceiving) electric waves is also being considered.

In particular, an antenna is a device configured to transmit and receive (transceive) radio electromagnetic waves for radio communications. The mobile terminal is provided with various functions such as WIBRO and DMB, in addition to voice call functions. Therefore, the antenna implements bandwidths for satisfying such functions, and should be designed to have a small size so as to be mounted in the mobile terminal.

To meet such demand, antennas capable of implementing multi frequency bands are being designed. However, the antennas have complicated structures, and it is difficult to independently control parameter values which determine antenna characteristics such as the resonant frequency, the bandwidth and the gain.

SUMMARY OF THE INVENTION

Therefore, an aspect of the detailed description is to provide a mobile terminal having an antenna device capable of transceiving radio electromagnetic wave in a multi frequency band.

Another aspect of the detailed description is to provide a mobile terminal having an antenna device of more enhanced efficiency and a smaller size.

To achieve these and other advantages and in accordance with the purpose of this specification, as embodied and broadly described herein, there is provided a mobile terminal, comprising: a terminal body; and an antenna device mounted in the terminal body, wherein the antenna device comprises a first conductive member formed such that the antenna device resonates at a first frequency band; a second conductive member diverging from the first conductive member, and extending by a prescribed length; and a ground member spaced from the second conductive member, and capacitive-coupled to the second conductive member, such that a frequency resonance added by the second conductive member is generated near a center frequency of the first frequency band.

According to an embodiment of the present invention, the first conductive member and the second conductive member may be formed on a surface of a carrier formed as a polyhedron.

According to an embodiment of the present invention, the first conductive member may be bent from one surface of the carrier to extend to another neighboring surface, so as to have a length corresponding to the center frequency of the first frequency band.

According to an embodiment of the present invention, the second conductive member may extend from the part where the first conductive member is bent, toward the ground member.

According to an embodiment of the present invention, the first conductive member may be feed-connected or ground-connected to a flexible printed circuit board (FPCB) disposed below the carrier.

According to an embodiment of the present invention, the first conductive member may operate as an inverted F type antenna.

According to an embodiment of the present invention, the FPCB may be connected to a circuit board configured to control the antenna device.

According to an embodiment of the present invention, the ground member may be formed below the circuit board, and the ground member may be formed to extend a ground of the circuit board.

According to an embodiment of the present invention, the second conductive member may not be disposed at a region above the ground member.

According to an embodiment of the present invention, the first conductive member may comprise a first extension portion and a second extension portion spaced from each other in parallel, and capacitive-coupled to each other.

According to another aspect of the present invention, there is provided a mobile terminal, comprising: a terminal body; and an antenna device mounted in the terminal body, wherein the antenna device comprises a first conductive member formed such that the antenna device resonates at a first frequency; a second conductive member diverging from the first conductive member, such that the antenna device resonates at a second frequency; and a ground member that forms a capacitive coupling with the second conductive member, such that a resonance by the second conductive member is generated at a third frequency adjacent to the first frequency.

The mobile terminal according to at least one embodiment of the present invention can have the following advantages.

The second conductive member diverging from the first conductive member is capacitive-coupled to the ground, such that a second resonant frequency by the second conductive member overlaps a first resonant frequency by the first conductive member, or such that the second resonant frequency is formed near the first resonant frequency. Under such configuration, a bandwidth of the antenna device can be increased, and radiation efficiency of the antenna device can be improved.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a mobile terminal according to an embodiment of the present invention will be explained in more detail with reference to the attached drawings. The suffixes "module" and "unit or portion" for components used in the following description merely provided only for facilitation of preparing this specification, and thus they are not granted a specific meaning or function. For the sake of brief description with reference to the drawings, the same or equivalent components will be provided with the same reference numbers, and description thereof will not be repeated. Singular expressions include plural expressions which do not have any obviously different meaning in view of a context.

The mobile terminal according to an embodiment of the present invention may include a portable phone, a smart phone, a laptop computer, a digital broadcasting terminal, Personal Digital Assistants (PDA), Portable Multimedia Player (PMP), a navigation system, etc. However, the present invention is also applicable to a fixed terminal such as a digital TV and a desktop computer.

Figure 1:
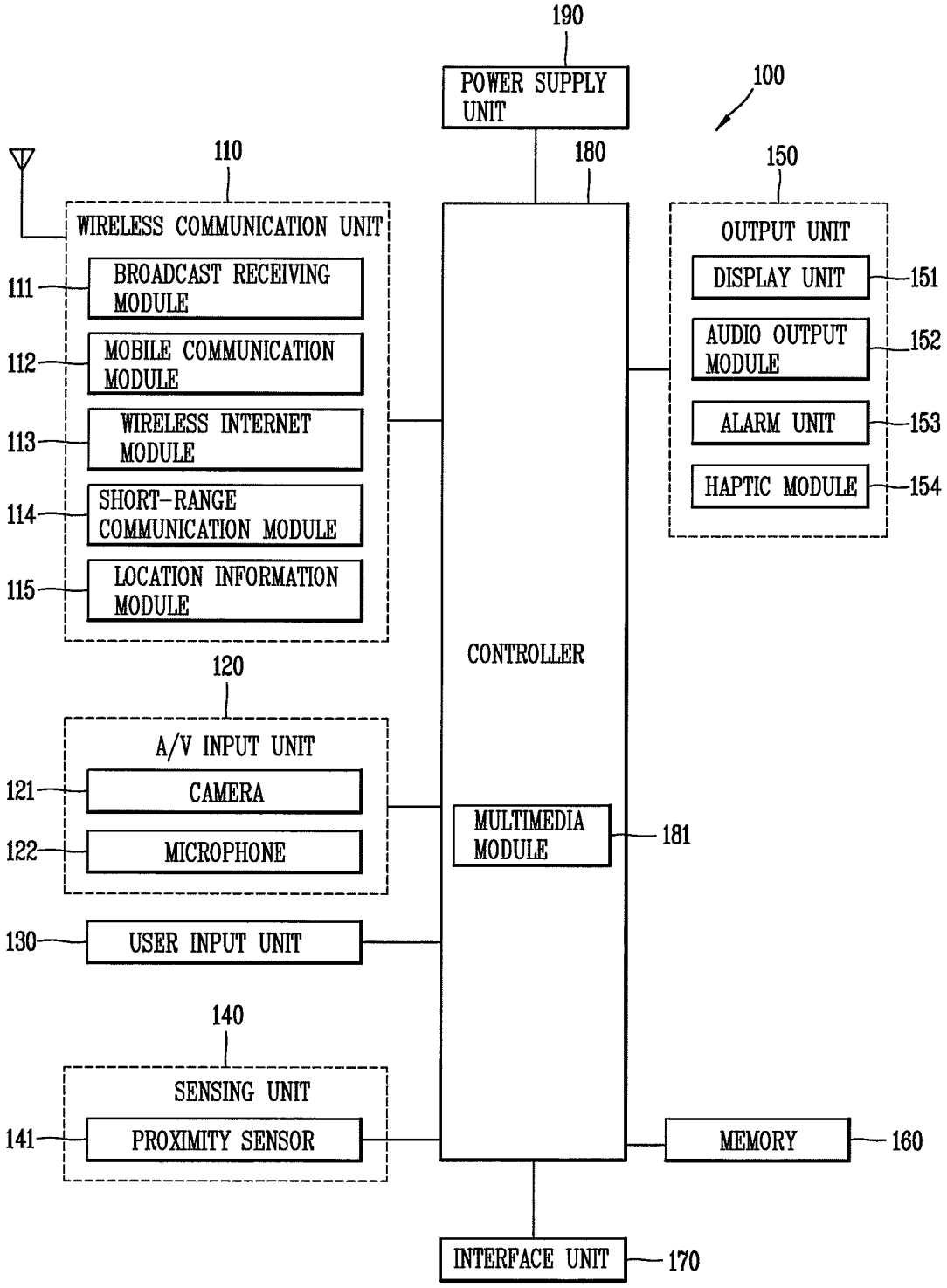
FIG. 1 is a block diagram of a mobile terminal according to an embodiment of the present invention.

In FIG. 1, the mobile terminal 100 includes components, such as a wireless communication unit 110, an Audio/Video (A/V) input unit 120, a user input unit 130, a sensing unit 140, an output module 150, a memory 160, an interface unit 170, a controller 180, a power supply unit 190, and the like. FIG. 1 shows the mobile terminal 100 having various components, but implementing all of the illustrated components is not a requirement. Greater or fewer components may alternatively be implemented.

Hereinafter, each component is described in sequence.

The wireless communication unit 110 may typically include one or more components which permit wireless communications between the mobile terminal 100 and a wireless communication system or between the mobile terminal 100 and a network within which the mobile terminal 100 is located. For example, the wireless communication unit 110 may include a broadcast receiving module 111, a mobile communication module 112, a wireless internet module 113, a short-range communication module 114, a position information module 115 and the like.

The broadcast receiving module 111 receives broadcast signals and/or broadcast associated information from an external broadcast management server (or other network entity) via a broadcast channel. The broadcast channel may include a satellite channel and/or a terrestrial channel. The broadcast management server may be a server that generates and transmits a broadcast signal and/or broadcast associated information or a server that receives a previously generated broadcast signal and/or broadcast associated information and transmits the same to a terminal.

The broadcast associated information may refer to information associated with a broadcast channel, a broadcast program or a broadcast service provider. The broadcast signal may include a TV broadcast signal, a radio broadcast signal, a data broadcast signal, and the like. Also, the broadcast signal may further include a broadcast signal combined with a TV or radio broadcast signal.

The broadcast associated information may also be provided via a mobile communication network and, in this instance, the broadcast associated information may be received by the mobile communication module 112. Further, the broadcast signal may exist in various forms. For example, it may exist in the form of an electronic program guide (EPG) of digital multimedia broadcasting (DMB), electronic service guide (ESG) of digital video broadcast-handheld (DVB-H), and the like.

The broadcast receiving module 111 may be configured to receive signals broadcast by using various types of broadcast systems. In particular, the broadcast receiving module 111 may receive a digital broadcast by using a digital broadcast system such as multimedia broadcasting-terrestrial (DMB-T), digital multimedia broadcasting-satellite (DMB-S), digital video broadcast-handheld (DVB-H), the data broadcasting system known as media forward link only (MediaFLO®), integrated services digital broadcast-terrestrial (ISDB-T), etc.

The broadcast receiving module 111 may be configured to be suitable for every broadcast system that provides a broadcast signal as well as the above-mentioned digital broadcast systems. Broadcasting signals and/or broadcasting associated information received through the broadcast receiving module 111 may be stored in the memory 160.

The mobile communication module 112 transmits/receives wireless signals to/from at least one of network entities (e.g., base station, an external terminal, a server, etc.) on a mobile communication network. Here, the wireless signals may include audio call signal, video call signal, or various formats of data according to transmission/reception of text/multimedia messages.

The wireless internet module 113 supports wireless Internet access for the mobile terminal. This module may be internally or externally coupled to the mobile terminal 100. Examples of such wireless Internet access may include Wireless LAN (WLAN) (WI-FI), Wireless Broadband (WIBRO), World Interoperability for Microwave Access (WIMAX), High Speed Downlink Packet Access (HSDPA), and the like.

In addition, the short-range communication module 114 denotes a module for short-range communications. Suitable technologies for implementing this module may include BLUETOOTH, Radio Frequency IDentification (RFID), Infrared Data Association (IrDA), Ultra-WideBand (UWB), ZigBee, and the like.

The position information module 115 denotes a module for sensing or calculating a position of a mobile terminal. An example of the position information module 115 may include a Global Position System (GPS) module.

Referring to FIG. 1, the A/V input unit 120 is configured to receive an audio or video signal. The A/V input unit 120 may include a camera 121, a microphone 122 or the like. The camera 121 processes image frames such as still images or moving images acquired by an image sensor in a video call mode or an image capturing mode.

The processed image frames may be displayed on a display unit 151. Further, the image frames processed by the camera 121 may be stored in the memory 160 or transmitted to the outside via the wireless communication unit 110. Two or more cameras 121 may be provided according to the configuration of the mobile terminal.

The microphone 122 can receive sounds (audible data) via a microphone in a phone call mode, a recording mode, a voice recognition mode, and the like, and can process such sounds into audio data. The processed audio (voice) data may be converted for output into a format transmittable to a mobile communication base station via the mobile communication module 112 for the phone call mode. The microphone 122 may implement various types of noise canceling (or suppression) algorithms to cancel (or suppress) noise or interference generated while receiving and transmitting audio signals.

The user input unit 130 can generate input data for allowing a user to control various operations of the mobile communication terminal. The user input unit 130 may include a keypad, a dome switch, a touch pad (e.g., a touch sensitive member that detects changes in resistance, pressure, capacitance, etc. due to being contacted) a jog wheel, a jog switch, and the like.

Further, the sensing unit 140 detects a current status (or state) of the mobile terminal 100 such as an opened or closed state of the mobile terminal 100, a location of the mobile terminal 100, the presence or absence of user contact with the mobile terminal 100 (e.g., touch inputs), the orientation of the mobile terminal 100, an acceleration or deceleration movement and direction of the mobile terminal 100, etc., and generates commands or signals for controlling the operation of the mobile terminal 100.

For example, when the mobile terminal 100 is implemented as a slide type mobile phone, the sensing unit 140 may sense whether the slide phone is opened or closed. In addition, the sensing unit 140 can detect whether or not the power supply unit 190 supplies power or whether or not the interface unit 170 is coupled with an external device. The sensing unit 140 may include a proximity sensor 141.

The output unit 150 is configured to provide outputs in a visual, audible, and/or tactile manner. The output unit 150 may include the display unit 151, an audio output module 152, an alarm unit 153, a haptic module 154, and the like.

The display unit 151 may display information processed in the mobile terminal 100. For example, when the mobile terminal 100 is in a phone call mode, the display unit 151 may display a User Interface (UI) or a Graphic User Interface (GUI) associated with a call. When the mobile terminal 100 is in a video call mode or image capturing mode, the display unit 151 may display a captured image and/or received image, or a UI or GUI.

The display unit 151 may include at least one of a Liquid Crystal Display (LCD), a Thin Film Transistor-LCD (TFT-LCD), an Organic Light Emitting Diode (OLED) display, a flexible display, a three-dimensional (3D) display, or the like. Some of these displays may be configured to be transparent so that outside may be seen therethrough, which may be referred to as a transparent display.

A representative example of the transparent display may include a Transparent Organic Light Emitting Diode (TOLED), and the like. The rear surface portion of the display unit 151 may also be implemented to be optically transparent. Under such configuration, a user can view an object positioned at a rear side of a body through a region occupied by the display unit 151 of the body.

The display unit 151 may be implemented in two or more in number according to a configured aspect of the mobile terminal 100. For instance, a plurality of displays may be arranged on one surface integrally or separately, or may be arranged on different surfaces.

Here, if the display unit 151 and a touch sensitive sensor (referred to as a touch sensor) have a layered structure therebetween, the structure may be referred to as a touch screen. The display unit 151 may be used as an input device rather than an output device. The touch sensor may be implemented as a touch film, a touch sheet, a touch pad, and the like.

The touch sensor may be configured to convert changes of a pressure applied to a specific part of the display unit 151, or capacitance occurring from a specific part of the display unit 151, into electric input signals. Also, the touch sensor may be configured to sense not only a touched position and a touched area, but also a touch pressure.

When touch inputs are sensed by the touch sensors, corresponding signals are transmitted to a touch controller. The touch controller processes the received signals, and then transmits corresponding data to the controller 180. Accordingly, the controller 180 can sense which region of the display unit 151 has been touched.

Referring to FIG. 1, the proximity sensor 141 may be arranged at an inner region of the mobile terminal blocked by the touch screen, or near the touch screen. The proximity sensor 141 indicates a sensor to sense presence or absence of an object approaching to a surface to be sensed, or an object disposed near a surface to be sensed, by using an electromagnetic field or infrared rays without a mechanical contact. The proximity sensor 141 has a longer lifespan and a more enhanced utility than a contact sensor.

The proximity sensor 141 may include a transmissive type photoelectric sensor, a direct reflective type photoelectric sensor, a mirror reflective type photoelectric sensor, a high-frequency oscillation proximity sensor, capacitance type proximity sensor, a magnetic type proximity sensor, an infrared rays proximity sensor, and so on. When the touch screen is implemented as capacitance type, proximity of a pointer to the touch screen is sensed by changes of an electromagnetic field. In this instance, the touch screen (touch sensor) may be categorized into a proximity sensor.

Hereinafter, for the sake of brief explanation, a status that the pointer is positioned to be proximate onto the touch screen without contact will be referred to as 'proximity touch', whereas a status that the pointer substantially comes in contact with the touch screen will be referred to as 'contact touch'. For the position corresponding to the proximity touch of the pointer on the touch screen, such position corresponds to a position where the pointer faces perpendicular to the touch screen upon the proximity touch of the pointer.

The proximity sensor 141 senses proximity touch, and proximity touch patterns (e.g., distance, direction, speed, time, position, moving status, etc.). Information relating to the sensed proximity touch and the sensed proximity touch patterns may be output onto the touch screen.

The audio output module 152 can convert and output as sound audio data received from the wireless communication unit 110 or stored in the memory 160 in a call signal reception mode, a call mode, a record mode, a voice recognition mode, a broadcast reception mode, and the like. Also, the audio output module 152 can provide audible outputs related to a particular function performed by the mobile terminal 100 (e.g., a call signal reception sound, a message reception sound, etc.). The audio output module 152 may include a speaker, a buzzer, and so on.

The alarm unit 153 can provide outputs to inform about the occurrence of an event of the mobile terminal 100. Typical events include call reception, message reception, key signal inputs, a touch input, etc. In addition to audio or video outputs, the alarm unit 153 can provide outputs in a different manner to inform a user about the occurrence of an event. The video signal or the audio signal can be output via the display unit 151 or the audio output module 152. Accordingly, the display unit 151 or the audio output module 152 may be classified as part of the alarm unit 153.

The haptic module 154 generates various tactile effects which a user can feel. A representative example of the tactile effects generated by the haptic module 154 includes vibration. Vibration generated by the haptic module 154 can have a controllable intensity, a controllable pattern, and so on. For instance, different vibration can be output in a synthesized manner or in a sequential manner.

The haptic module 154 can generate various tactile effects, including not only vibration, but also arrangement of pins vertically moving with respect to a skin being touched (contacted), air injection force or air suction force through an injection hole or a suction hole, touch by a skin surface, presence or absence of contact with an electrode, effects by stimulus such as an electrostatic force, reproduction of cold or hot feeling using a heat absorbing device or a heat emitting device, and the like.

The haptic module 154 can be configured to transmit tactile effects (signals) through a user's direct contact, or a user's muscular sense using a finger or a hand. The haptic module 154 can be implemented in two or more in number according to the configuration of the mobile terminal 100.

The memory 160 can store a program for the processing and control of the controller 180. Alternatively, the memory 160 can temporarily store input/output data (e.g., phonebook data, messages, still images, video and the like). Also, the memory 160 can store data relating to various patterns of vibrations and audio output upon the touch input on the touch screen.

The memory 160 can be implemented using any type of suitable storage medium including a flash memory type, a hard disk type, a multimedia card micro type, a memory card type (e.g., SD or DX memory), Random Access Memory (RAM), Static Random Access Memory (SRAM), Read-Only Memory (ROM), Electrically Erasable Programmable Read-only Memory (EEPROM), Programmable Read-only Memory (PROM), magnetic memory, magnetic disk, optical disk, and the like. Also, the mobile terminal 100 can operate a web storage which performs the storage function of the memory 160 on the Internet.

The interface unit 170 can generally be implemented to interface the mobile terminal with external devices. The interface unit 170 can allow a data reception from an external device, a power delivery to each component in the mobile terminal 100, or a data transmission from the mobile terminal 100 to an external device. The interface unit 170 may include, for example, wired/wireless headset ports, external charger ports, wired/wireless data ports, memory card ports, ports for coupling devices having an identification module, audio Input/Output (I/O) ports, video I/O ports, earphone ports, and the like.

The identification module may be configured as a chip for storing various information required to authenticate an authority to use the mobile terminal 100, which may include a User Identity Module (UIM), a Subscriber Identity Module (SIM), a Universal Subscriber Identity Module (USIM), and the like. Also, the device having the identification module (hereinafter, referred to as 'identification device') may be implemented in a type of smart card. Hence, the identification device can be coupled to the mobile terminal 100 via a port.

Also, the interface unit 170 can serve as a path for power to be supplied from an external cradle to the mobile terminal 100 when the mobile terminal 100 is connected to the external cradle or as a path for transferring various command signals input from the cradle by a user to the mobile terminal 100. Such various command signals or power input from the cradle can operate as signals for recognizing that the mobile terminal 100 has accurately been mounted to the cradle.

The controller 180 typically controls the overall operations of the mobile terminal 100. For example, the controller 180 performs the control and processing associated with telephony calls, data communications, video calls, and the like. The controller 180 can include a multimedia module 181 which provides multimedia playback. The multimedia module 181 can be configured as part of the controller 180 or as a separate component. The controller 180 can also perform a pattern recognition processing so as to recognize writing or drawing input on the touch screen as text or image.

The power supply unit 190 serves to supply power to each component by receiving external power or internal power under control of the controller 180.

Various embodiments described herein can be implemented in a computer-readable medium using, for example, software, hardware, or some combination thereof. For a hardware implementation, the embodiments described herein can be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, micro processors, other electronic units designed to perform the functions described herein, or a selective combination thereof. In some cases, such embodiments are implemented by the controller 180.

For a software implementation, the embodiments such as procedures and functions can be implemented together with separate software modules each of which performs at least one of functions and operations. The software codes can be implemented with a software application written in any suitable programming language. Also, the software codes can be stored in the memory 160 and executed by the controller 180.

Figure 2:
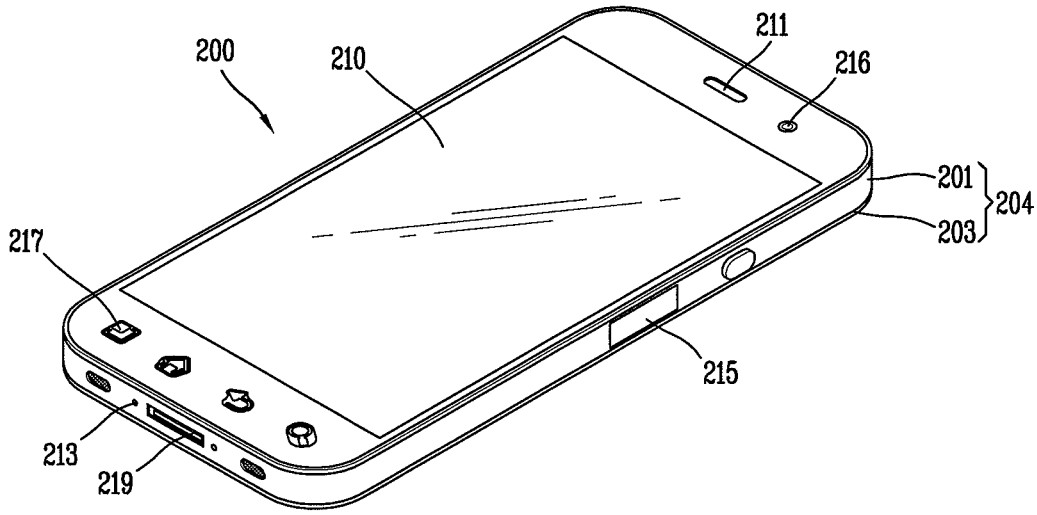
FIG. 2 is a front perspective view of a mobile terminal according to an embodiment of the present invention.
Figure 3:
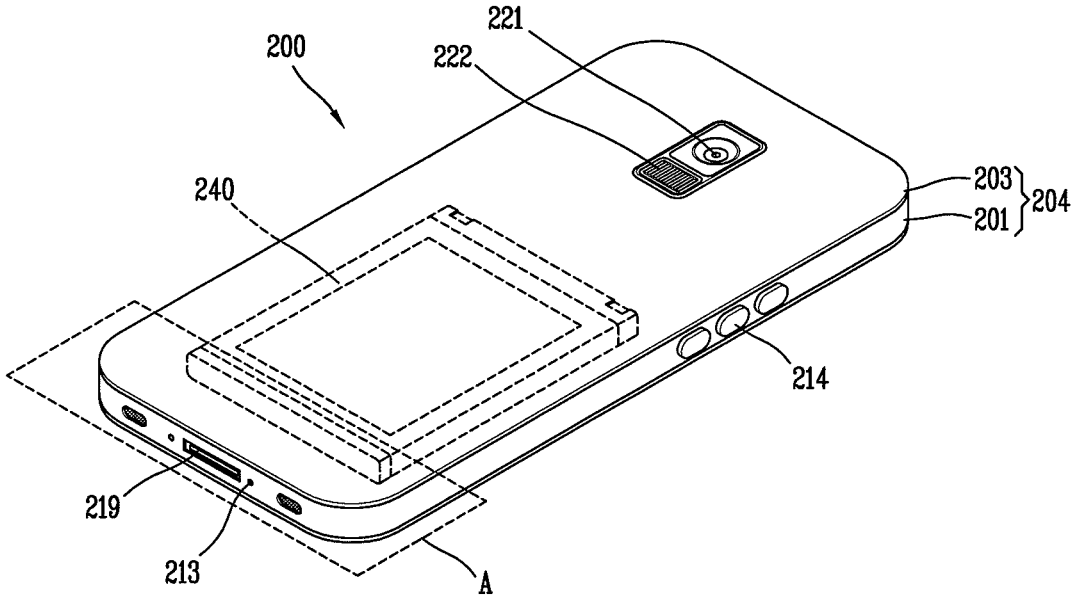
FIG. 3 is a rear perspective view of the mobile terminal of FIG. 2.

Next, FIG. 2 is a front perspective view of a mobile terminal 200 according to an embodiment of the present invention, and FIG. 3 is a rear perspective view of the mobile terminal of FIG. 2.

Referring to FIGS. 2 and 3, the mobile terminal 200 according to an embodiment of the present invention is provided with a bar type terminal body 204. However, the present invention is not limited to this, but can be applied to a slide type in which two or more bodies are coupled to each other so as to perform a relative motion, a folder type, a swing type, and the like. Further, the mobile terminal of the present invention can be applied to any portable electronic device having a camera and a flash, for instance, a portable phone, a smart phone, a notebook computer, a digital broadcasting terminal, Personal Digital Assistants (PDAs), Portable Multimedia Players (PMO), etc.

The mobile terminal 200 includes the terminal body 204 which forms the appearance thereof. A case (casing, housing, cover, etc.) which forms the appearance of the terminal body 204 can include a front case 201, a rear case 202, and a battery cover 203 for covering the rear surface of the rear case 202.

A space formed by the front case 201 and the rear case 202 can accommodate various components therein. Such cases may be formed by injection-molded synthetic resin, or may be formed using a metallic material such as stainless steel (STS) or titanium (Ti).

On the front surface of the terminal body 204, a display unit 210, a first audio output unit 211, a front camera 216, and a user input unit 217 may be disposed. A side key 214 and 215, and an interface unit 219 are disposed on sides of the terminal 204 in the example shown in FIGS. 2 and 3.

The display unit 210 includes a liquid crystal display (LCD) module, organic light emitting diodes (OLED) module, e-paper, etc., each for visually displaying information. The display unit 210 may include a touch sensing mechanism for inputting information in a touch manner. Hereinafter, the display unit 210 including the touch sensing means is called 'touch screen'.

Once part on the touch screen 210 is touched, content corresponding to the touched position is input. The content input in a touch manner, may be characters, or numbers, or menu items which can be set in each mode. The touch sensing mechanism may be transmissive so that the display can be viewed, and may include a structure for enhancing visibility of the touch screen at a bright place. Referring to FIG. 2, the touch screen 210 occupies most of the front surface of the front case 201.

The first audio output unit 211 can be implemented as a receiver for transmitting a call sound to a user's ear, or a loud speaker for outputting each type of alarm sound or a playback sound of multimedia.

Further, the front camera 216 processes image frames such as still images or moving images, acquired by an image sensor in a video call mode or a capturing mode. The processed image frames can be displayed on the display unit 210.

The image frames processed by the front camera 216 can be stored in the memory 160, or can be transmitted to the outside through the wireless communication unit 110. The front camera 216 may be implemented in two or more according to a user's interface.

The user input unit 217 is manipulated to receive a command for controlling the operation of the mobile terminal 200, and may include a plurality of input keys. The input keys may be referred to as manipulation portions, and may include any type of ones that can be manipulated in a user's tactile manner.

For instance, the user input unit 217 can be implemented as a dome switch, or a touch screen, or a touch pad for inputting commands or information in a user's push or touch manner. Alternatively, the user input unit 217 can be implemented, for example, as a wheel for rotating a key, a jog, or a joystick. The user input unit 217 is configured to input various commands such as START, END and SCROLL.

The side key 214, interface unit 219, an audio input unit 213, etc. are disposed on the side surface of the front case 201. The side key 214 may be called 'manipulation unit', and may be configured to receive commands for controlling the operation of the mobile terminal 200. The side key 214 may include any type of ones that can be manipulated in a user's tactile manner.

Content input by the side key 214 may be variously set. For instance, through the side key 214, may be input commands such as controlling the front and rear cameras 216 and 221, controlling the level of sound output from the audio output unit 211, and converting a current mode of the display unit 210 into a touch recognition mode.

Further, the audio output unit 213 can be implemented as a microphone for receiving a user's voice, other sound, etc. The interface unit 219 serves a path through which the mobile terminal 200 performs data exchange, etc. with an external device. For example, the interface unit 219 can be at least one of a connection terminal through which the mobile terminal 200 is connected to an ear phone by cable or radio, a port for local area communication, e.g., an infrared data association (IrDA) port, a Bluetooth portion, a wireless LAN port, and power supply terminals for supplying power to the mobile terminal 200.

The interface unit 219 may be a card socket for accommodating an external card such as a subscriber identification module (SIM) card, a user identity module (UIM) card or a memory card for storing information.

A power supply unit 240 and the rear camera 221 are disposed on the rear surface of the body 204. Also, a flash 222 and a mirror may be disposed close to the rear camera 221. When capturing an object by using the rear camera 221, the flash 222 provides light onto the object.

When the user captures an image of himself/herself by using the rear camera 221, the mirror can be used for the user to look at himself/herself therein. Further, the rear camera 221 may face a direction which is opposite to a direction faced by the front camera 216, and may have different pixels from those of the front camera 216.

For example, the front camera 216 may operate with relatively lower pixels (lower resolution). Thus, the front camera 216 may be useful when a user can capture his face and send it to another party during a video call or the like. On the other hand, the rear camera 221 may operate with a relatively higher pixels (higher resolution) such that it can be useful for a user to obtain higher quality pictures for later use. The front camera 216 and the rear camera 221 may be installed at the terminal body 204 so as to rotate or pop-up.

The power supply unit 240 is configured to supply power to the mobile terminal 200. The power supply unit 240 may be mounted in the terminal body 204, or may be detachably mounted to the terminal body 204.

Figure 4:
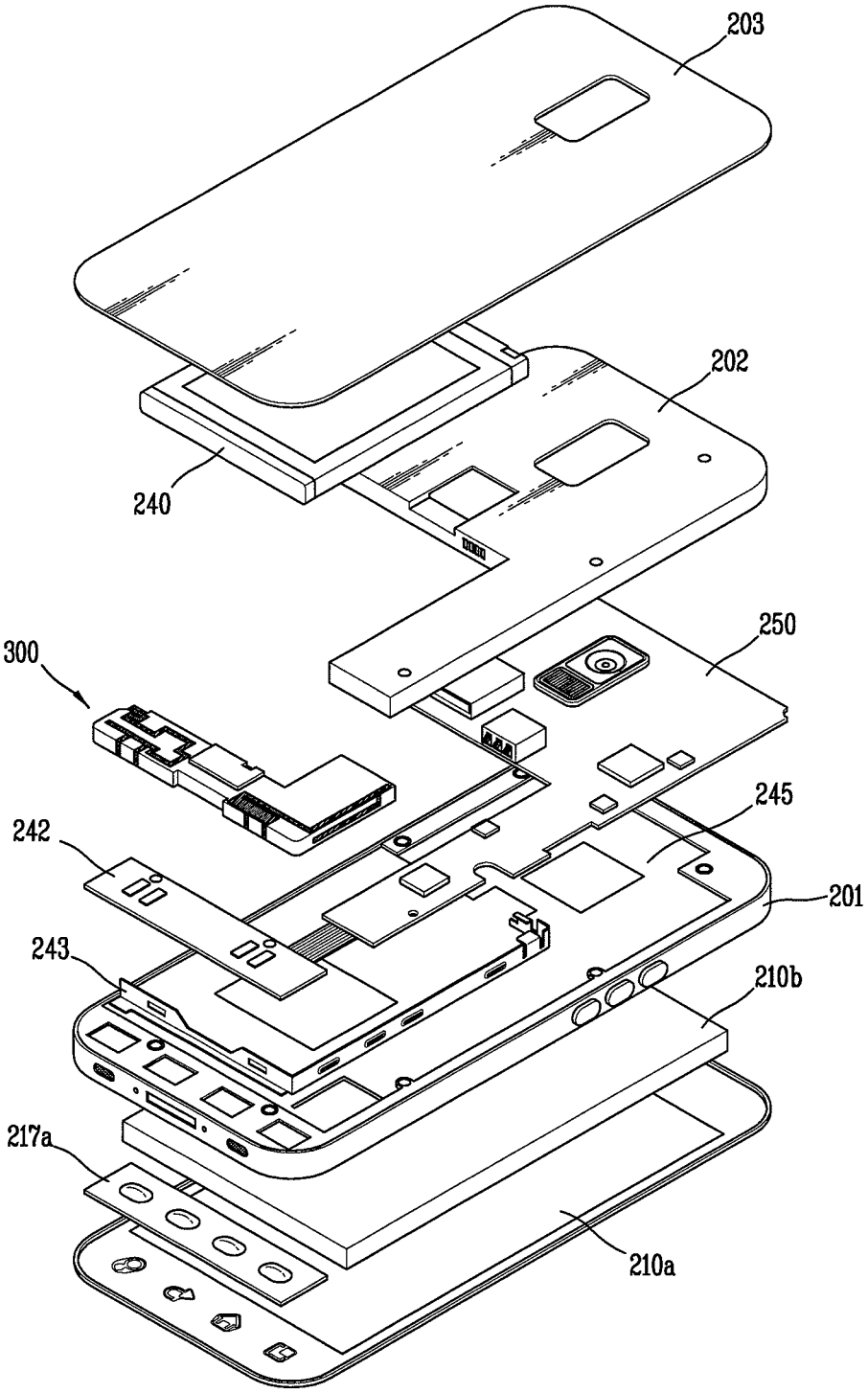
FIG. 4 is an exploded perspective view of FIG. 3.

Next, FIG. 4 is an exploded perspective view of the mobile terminal of FIG. 3. Referring to FIG. 4, the mobile terminal includes a window 210*a* and a display module 210*b* which constitute the display unit 210. The window 210*a* can be coupled to one surface of the front case 201.

A frame 245 is formed between the front case 201 and the rear case 202 so as to support electric devices. The frame 245, a structure for supporting inside of the mobile terminal, is formed so as to support at least one of the display module 210*b*, the camera module 221, the antenna device, the battery 240 and a circuit board 250.

Part of the frame 245 may be exposed to outside of the mobile terminal. Further, the frame 245 may constitute part of a sliding module for connecting a body part with a display part in a slide type mobile terminal rather than a bar type mobile terminal.

Referring to FIG. 4, the circuit board 250 is disposed between the frame 245 and the rear case 202, and the display module 210*b* is coupled to one surface of the frame 245. The circuit board 250 and the battery may be disposed on another surface of the frame 245, a battery case 203 for covering the battery may be coupled to the rear case 202.

The window 210*a* is coupled to one surface of the front case 201. A touch sensor may be mounted to the window 210*a*. The touch sensor is configured to sense a touch input, and is formed of a transmissive material. The touch sensor may be mounted to the front surface of the window 210*a*, and may be configured to convert a change of a voltage, etc. occurring on a specific part of the window 210*a*, into an electric input signal.

The display module 210*b* is mounted to the rear surface of the window 210*a*. In this embodiment, the display module 210*b* is implemented as a thin film transistor-liquid crystal display (TFT LCD). However, the present invention is not limited to this. For instance, the display module 210*b* may be implemented as a liquid crystal display (LCD), an organic light-emitting diode (OLED), a flexible display, a 3D display, etc.

As aforementioned, the circuit board 250 may be formed on one surface of the frame 245, but may be mounted below the display module 210*b*. At least one electronic device is mounted onto the lower surface of the circuit board 250.

A battery accommodation portion for accommodating the battery 240 therein is recessed from the frame 245. A contact terminal connected to the circuit board 250 may be formed on one side surface of the battery, so that the battery 240 can supply power to the terminal body.

An antenna device may be formed on an upper end or a lower end of the mobile terminal. The antenna device may be formed in plurality in number, and the plurality of antenna devices may be disposed at the respective ends. The antenna devices can be configured to transmit and receive radio signals in different frequency bands.

The frame 245 may be formed of a metallic material so as to have a sufficient strength even in a small thickness. The frame 245 formed of a metallic material may operate as a ground. That is, the circuit board 250 or the antenna device may be ground-connected to the frame 245, and the frame 245 may operate as a ground of the circuit board 250 or the antenna device. In this instance, the frame 245 may extend a ground of the mobile terminal.

The circuit board 250 is electrically connected to the antenna device, and is configured to process radio signals (or radio electromagnetic waves) transmitted and received by the antenna device. For processing of radio signals, a plurality of transceiving circuits may be mounted to the circuit board 250.

The transceiving circuits may include one or more integrated circuits and related electric devices. As an example, the transceiving circuits may include a transmission integrated circuit, a reception integrated circuit, a switching circuit, an amplifier, etc.

As the plurality of transceiving circuits simultaneously feed conductive members formed in conductive patterns, a plurality of antenna devices may simultaneously operate. For instance, while one of the transceiving circuits performs signal transmission, another may perform signal reception. Alternatively, both of the transceiving circuits may perform signal transmission or signal reception.

Coaxial cables may be formed to connect the circuit board 250 with the antenna devices. For instance, the coaxial cables may be connected to feeding devices for feeding the antenna devices. The feeding devices may be formed on one surface of a flexible printed circuit board (FPCB) 242 for processing signals input from the user input unit 217.

Another surface of the FPCB 242 may be coupled to a signal transmission unit 217*a* for transmitting signals of the user input unit 217. In this instance, a dome may be formed on another surface of the FPCB 242, and an actuator may be formed at the signal transmission unit 217*a*. A rib 243 is also provided.

Figure 5A:
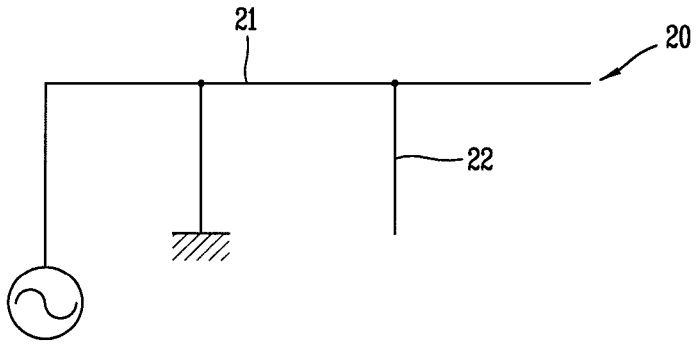
FIG. 5A is a conceptual view of an antenna device according to a comparative embodiment.
Figure 5B:
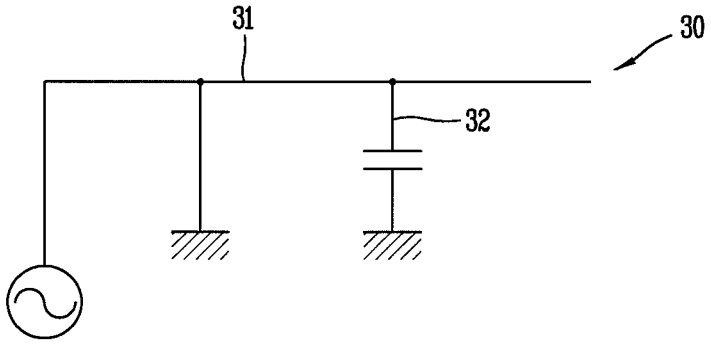
FIG. 5B is a conceptual view of an antenna device according to a preferred embodiment of the present invention.
Figure 5C:
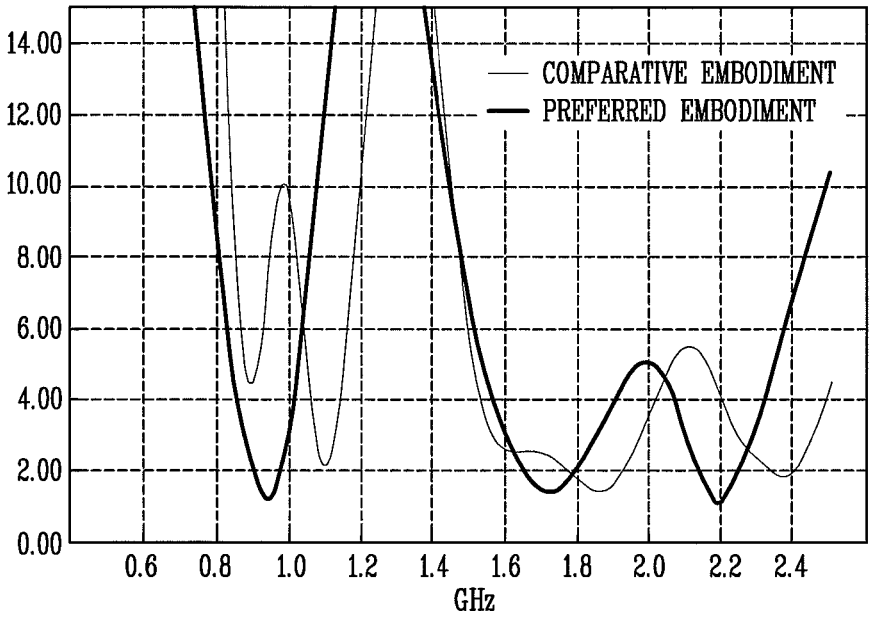
FIG. 5C is a view illustrating a voltage standing wave ratio (VSWR) according to a frequency of the antenna devices of FIGS. 5A and 5B.

Next, FIG. 5A is a conceptual view of an antenna device according to a comparative embodiment, FIG. 5B is a conceptual view of an antenna device according to a preferred embodiment of the present invention, and FIG. 5C is a view illustrating a voltage standing wave ratio (VSWR) according to a frequency of the antenna devices of FIGS. 5A and 5B.

An antenna device 20 of FIG. 5A is a general PIFA type where the antenna device is feed-connected or ground-connected to each end which extends from a first conductive member 21. That is, a feeding connector (F) to which a signal is input from a substrate, and a grounding connector (G) connected to a ground, are formed at parts which extend from the first conductive member 21 in a bending manner.

The first conductive member 21 may be formed to have a prescribed length, so that a resonance frequency of the antenna device is about 850 MHz in a $\lambda/4$ or $\lambda/8$ resonance mode. A second conductive member 22, diverging from the first conductive member 21 and extending from the diverging part, may be formed at part of the first conductive member 21. As the second conductive member 22 is added to the antenna device, the antenna device may have an additional resonant frequency. The additional resonant frequency may be variable according to a condition such as a length of the second conductive member 22. Referring to FIG. 5C, as the second conductive member 22 is added to the first conductive member 21, the antenna device has an additional resonant frequency at about 1100 MHz.

In order to increase a bandwidth of the antenna device mounted to the mobile terminal at a low frequency band, a new conductive member may be diverging from the existing conductive member for an additional resonant frequency as shown in a comparative embodiment. However, In this instance, a current which flows along the first conductive member 21 is diverging along the second conductive member 22. However, this lowers the radiation efficiency of the antenna device. Because lowering of the radiation efficiency influences on a bandwidth, a desired antenna performance cannot be achieved by merely adding the second conductive member 22 to the first conductive member 21.

In order to solve such problem, an antenna device 30 of FIG. 5B is provided. Referring to FIG. 5B, a second conductive member 32 diverging from a first conductive member 31 is gap coupling-connected to a ground of the antenna device. That is, the second conductive member 32 is spaced from a ground, and is coupling-connected to the ground. Such coupling ground-connection increases a value of a capacitive reactance. Since an input impedance by a capacitance is in inverse proportion to a frequency, a resonant frequency is reduced. This will be explained in more detail with reference to FIG. 5C.

As shown in FIG. 5C, when the second conductive member 32 has not been gap coupling-connected to the ground, a first resonant frequency of the antenna device by the first conductive member 31 is about 850 MHz, and a second resonant frequency of the antenna device by the added second conductive member 32 is about 1100 MHz. However, when the second conductive member 32 is gap coupling-connected to the ground, a capacitive reactance relating to the second conductive member 32 of the antenna device is increased. That is, as shown in FIG. 5C, the second resonant frequency can be shifted toward the first resonant frequency, a low frequency band.

In this embodiment, the second resonant frequency is formed to overlap the first resonant frequency, or is formed near the first resonant frequency. Under such configuration, a bandwidth of the antenna device can be increased, and radiation efficiency of the antenna device can be improved.

Figure 6:
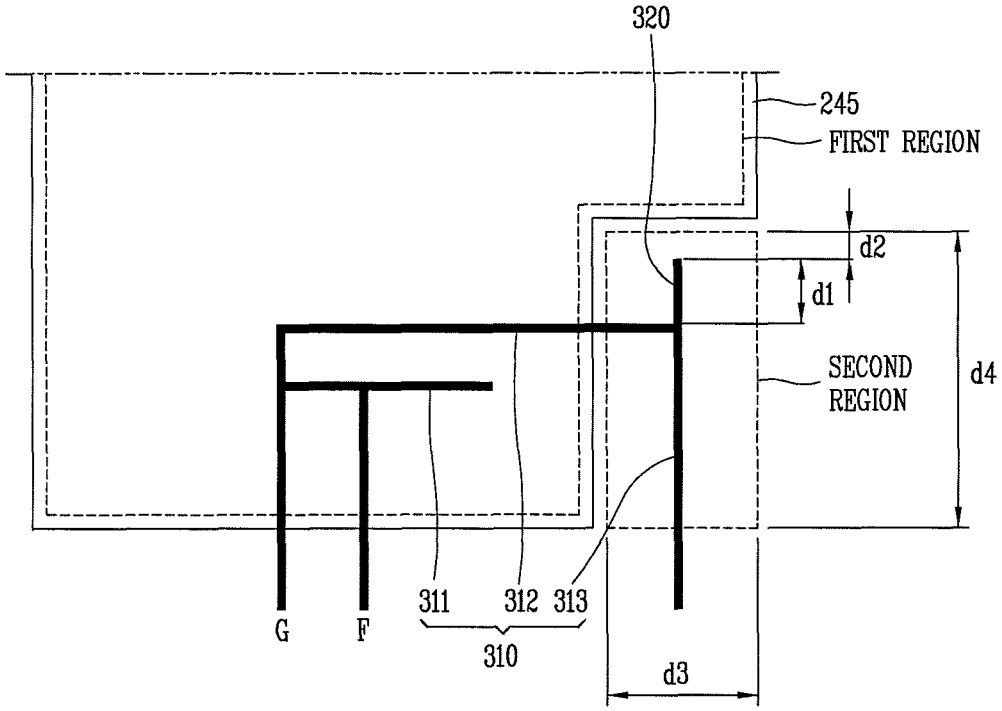
FIG. 6 is a conceptual view showing a relation between a conductive member and a ground of the antenna device of FIG. 5B.

FIG. 6 is a conceptual view showing a relation between a conductive member and a ground of the antenna device of FIG. 5B. The aforementioned frame 245 operates as a ground in the following embodiment.

A first conductive member 310 will be explained in more detail. The first conductive member 310 includes a first extension portion 311, a second extension portion 312 and a third extension portion 313. The first extension portion 311 and the second extension portion 312 are formed in parallel with prescribed lengths for gap coupling. The gap coupling between the first extension portion 311 and the second extension portion 312 is a sort of capacitive coupling, which increases a value of a capacitive reactance.

As aforementioned, if a value of a capacitive reactance is increased, a resonant frequency is reduced, because an input impedance by a capacitance is in inverse proportion to a frequency. Reduction of a resonant frequency means that conductive members serving as a radiator of the antenna device can operate at low frequencies band with shorter lengths, as the components of the antenna device are capacitive-coupled to each other. More specifically, if the antenna device includes members capacitive-coupled to each other, the antenna device can operate at a low frequency band in a narrower space.

A feeding connector (F) and a grounding connector (G) are connected to the first extension portion 311. The third extension portion 313 is bent from one end of the second extension portion 312, and extends by a prescribed length. As aforementioned, the third extension portion 313 may be formed on a different plane from the second extension portion 312, and may extend in a different direction from the second extension portion 312.

The second conductive member 320 is diverging from the first conductive member 310, and extends by a prescribed length. One end of the second conductive member 320 is connected to the first conductive member 310, and another end of the second conductive member 320 is spaced from the ground 245 to thus be capacitive-coupled to the ground 245.

The first conductive member 310 may be disposed to cover the ground 245. On the other hand, the ground 245 is not formed below the second conductive member 320. The first conductive member 310 and the second conductive member 320 may be printed onto one surface of the carrier 330 (FIG. 9) having a prescribed dielectric constant. The carrier 330 may be disposed to cover at least part of the ground 245. Under an assumption that a region including the ground 245 is a first region and a region not including the ground 245 is a second region, the second conductive member 320 may be disposed at an upper part of the second region.

Referring to FIG. 6, a configuration of an antenna device according to a preferred embodiment of the present invention will be explained. Firstly, when the antenna device operates in a $\lambda/4$ operation mode, the first conductive member 310 forms a resonant frequency corresponding to 700~900 MHz. More specifically, the first conductive member 310 may be disposed on the first region where the ground 245 is formed, or may be disposed on the second region where the ground 245 is not formed.

Then the second conductive member 320 is formed so as to be diverging from part of the first conductive member 310. The part of the first conductive member 310 may be a bending point of the first conductive member 310. A length (d1) of the second conductive member 320 may be within the range of 3.5~8 mm, so that the second conductive member can resonate at a prescribed frequency together with the first extension portion 311 and the second extension portion 312. A path including the first extension portion 311, the second extension portion 312 and the second conductive member 320 has an electrical length corresponding to about 1100 MHz.

Under the configuration that the second conductive member 320 is added to the first conductive member 310, if the first conductive member 310 forms a first resonant frequency within the range of 700900 MHz, a second resonant frequency may be formed at about 1100 MHz.

The second conductive member 320 is preferably disposed at the second region, and spaced from the ground 245. A horizontal spacing distance (d2) between the second conductive member 320 and the ground 245 may be 1.5~5 mm. A vertical spacing distance (h1, refer to FIG. 8) between the second conductive member 320 and the ground 245 may be 3~6 mm. The vertical spacing distance (h1) is related to a thickness of the carrier 330. The horizontal spacing distance (d2) may be increased or decreased according to the vertical spacing distance (h1).

The second region may have a size so that its length (d4) in a lengthwise direction can be 10~20 mm, and its length (d3) in a widthwise direction can be 3.5~5.5 mm. Main radiation from the antenna device is performed at one end of each of the first conductive member 310 and the second conductive member 320 disposed on the second region. Therefore, the ends of the first conductive member 310 and the second conductive member 320 should be disposed on the second region where the ground 245 is not formed, for an enhanced antenna performance.

Figure 7:
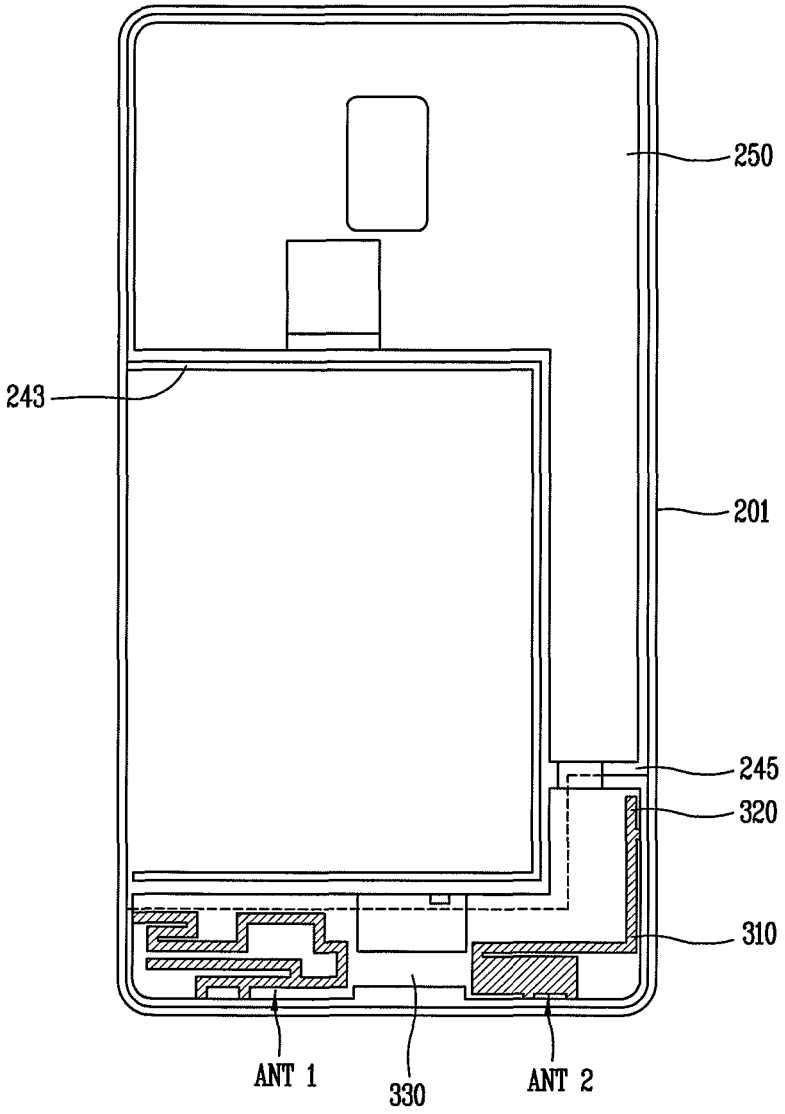
FIG. 7 is a view showing an example where an antenna device according to a preferred embodiment of the present invention is mounted in a terminal body.
Figure 8:
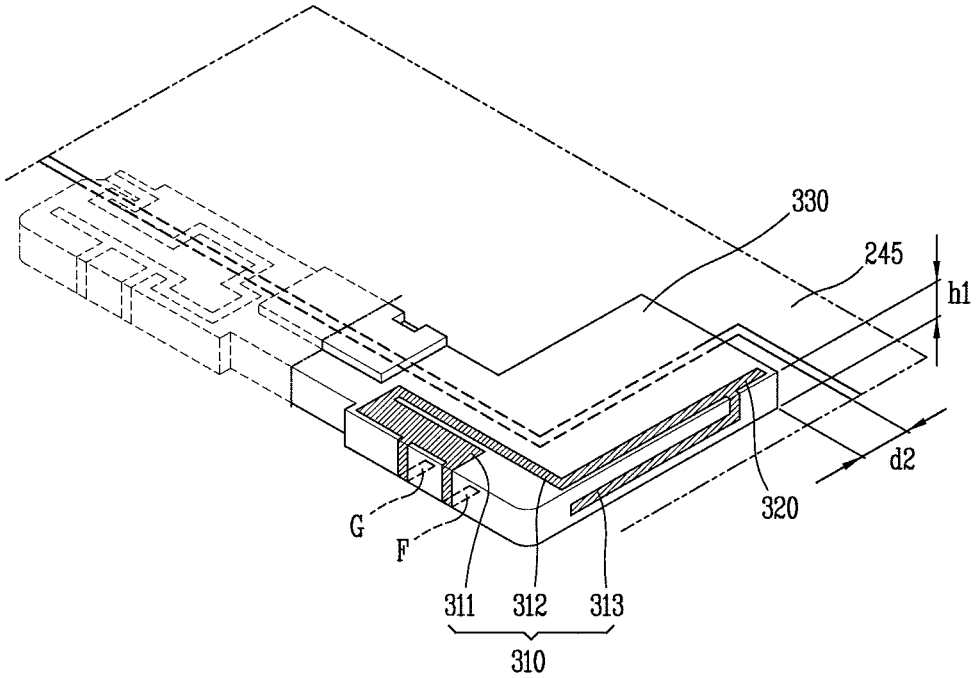
FIG. 8 is a perspective view of the antenna device of FIG. 7.

Next, FIG. 7 is a view showing an example where an antenna device according to a preferred embodiment of the present invention is mounted in a terminal body, and FIG. 8 is a perspective view of the antenna device of FIG. 7.

Referring to FIGS. 4 and 7A, the frame 245, which is formed to support inside of the mobile terminal, may be coupled to the front case 201. One surface of the frame 245 comes in contact with the display module 210*b*, thereby supporting the display module 210*b*. Another surface of the frame 245 is formed to support the battery 240 and the circuit board 250. The frame 245 may include a rib 243 for separating a region including the battery 240, from a region including the circuit board 250. The rib 243 may extend so that a region including the carrier 330, can be partitioned from a region including the battery 240.

The frame 245 and the rib 243 are formed to cover the carrier 330, which may reduce a user's specific absorption rate (SAR) by shielding an electromagnetic wave. That is, the frame 245 is formed to cover part of the mobile terminal which is toward a user's face during a call, thereby reducing SAR.

The carrier 330 is disposed between the case and the rib 243, and is formed as a polyhedron. The first conductive member 310 and the second conductive member 320 of the antenna device may extend along an outer surface of the carrier 330, via a plurality of surfaces. The first conductive member 310 and the second conductive member 320 may be coupled to the carrier 330 in a thermosetting manner or in a pressing manner (a conductive metallic plate which will serve as a radiator, is mounted to the plastic carrier 330 of a proper shape, in a pressing manner).

Alternatively, the first conductive member 310 and the second conductive member 320 may be printed onto one surface of the carrier 330. Still alternatively, the first conductive member 310 and the second conductive member 320 may be formed as films, and then the films may be attached to one surface of the carrier 330.

Referring to FIG. 8, an upper surface of the carrier 330 is a main surface where the first conductive member 310 and the second conductive member 320 are formed. A feeding connector (F) for feeding the first conductive member 310 and the second conductive member 320, or a grounding connector (G) for grounding the first conductive member 310 and the second conductive member 320 are formed on a lower surface of the carrier 330.

The first conductive member 310 extends along an upper surface of the carrier 330, and is bent to thus extend up to another surface of the carrier 330. The reason why the first conductive member 310 is formed along a plurality of surfaces of the carrier 330 is in order to form an electric length of the first conductive member 310 in a smaller space.

Further, the first conductive member 310 is connected to a feeding connector (F) and a grounding connector (G) so as to operate as an inverted F type antenna. The feeding connector (F) is configured to electrically connect a feeding device (not shown) with the first conductive member 310, or to feed the first conductive member 310 in an electromagnetic feeding manner.

For such a connection, the feeding connector (F) may include at least one of a feeding plate, a feeding clip and a feeding line. One of the feeding plate, the feeding clip and the feeding line may be electrically connected to another, thereby transmitting a current (or voltage) fed by the feeding device to the conductive members which transmit and receive radio signals. Here, the feeding line may include a micro-strip printed onto the PCB.

A matching portion may be formed between the feeding connector (F) and the feeding device. The matching portion may be implemented as a series element or a shunt element. In a case where the matching portion is implemented as a series element, a reactance, an imaginary number part of an impedance, may be changed.

For instance, an inductor may be controlled to have a high reactance, but a capacitor may be controlled to have a low reactance to thus change an impedance in a first frequency band. On the contrary, when the matching portion is implemented as a shunt element, a resistance, a real number part of an impedance, may be changed. For instance, an inductor can be set to have a high resistance, but a capacitor can be set to have a low resistance to thus change an impedance in a first frequency band.

The grounding connector (G) may connect the first conductive member 310 and the ground 245 to each other, and electrically short the first conductive member 310 to thus perform impedance matching with respect to a resonant frequency of the antenna device. The grounding connector (G) may be provided with at least two paths of different lengths, and may be provided with switches corresponding to the respective paths.

Further, the respective paths connect the grounds and the radiator (e.g., the first conductive member 310) with each other, in different lengths, by switches thereof. The path serves as an electric passage for connecting a ground with a radiator, which may include at least one of a feeding board, a feeding clip and feeding lines. As feeding lines are formed in different lengths, the paths may have different lengths.

As the carrier 330 which is a sort of dielectric substance, FR-3 and CEM-1 may be used. The FR-3 is made of multiple plies of paper that have been impregnated with an epoxy-resin binder, and the CEM-1 is a composite material that has a paper core impregnated with epoxy resin. Alternatively, the dielectric substance may be implemented as CEM-3, FR-4, FR-5 or GI. The CEM-3 impregnated with epoxy resin has woven glass cloth surfaces, and a core of non-woven matte fiberglass.

In addition, the FR-4 is constructed on multiple plies of epoxy-resin impregnated woven glass cloth. The FR-5 is constructed on multiple plies of reinforced epoxy-resin impregnated woven glass cloth. The GI is constructed on multiple plies of polyimide-resin impregnated woven glass cloth. Alternatively, the dielectric substance may be implemented as a printed circuit board (PCB).

Figure 9:
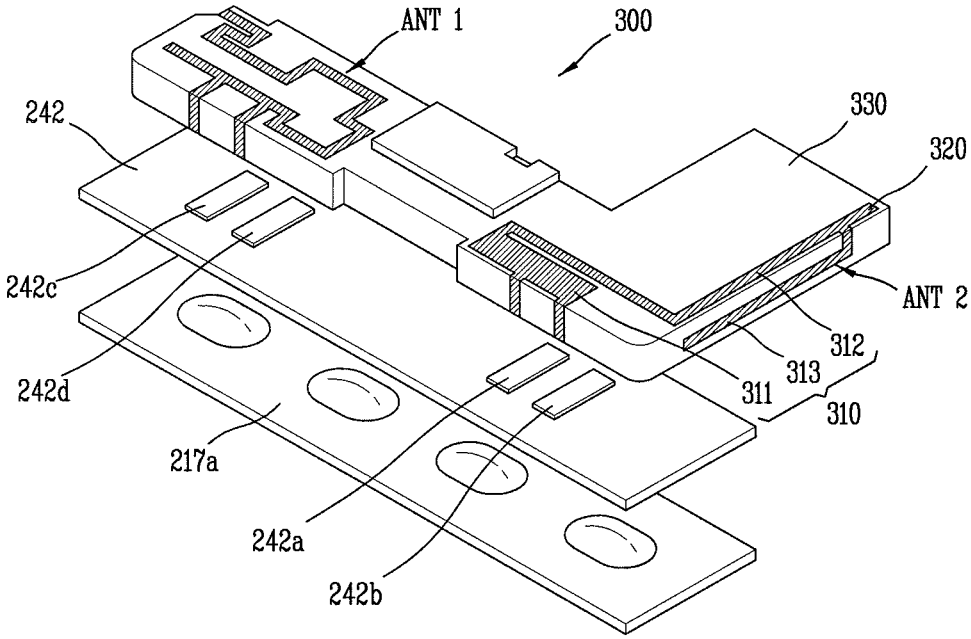
FIG. 9 is a conceptual view of part 'A' in FIG. 3, which shows an example where an antenna device is mounted to a lower part of a terminal body.

Next, FIG. 9 is a conceptual view of part 'A' in FIG. 3, which shows an example where an antenna device is mounted to a lower part of a terminal body. Antenna devices (ANT 1 and ANT 2) may be formed on one side and another side of the carrier 330. The respective antenna devices (ANT1 and ANT2) are configured to transceive signals in different frequency bands.

For instance, the first antenna device (ANT 1) may be configured to transceive DCN 1x type or PCS 1x type signals, and the second antenna device (ANT 2) may be configured to transceive DCN EVDO (Evolution-Data Optimized or Evolution-Data Only) type signals.

If the first antenna device (ANT 1) transceives LTE B4 type signals, the second antenna device (ANT 2) may transceive LTE B13 type signals. Alternatively, if the first antenna device (ANT 1) transceives signals corresponding to voice service of the mobile terminal, the second antenna device (ANT 2) can transceive data signals corresponding to LTE service of the mobile terminal.

The flexible printed circuit board (FPCB) 242 is connected to a lower part of the carrier 330. One end of the FPCB 242 may be connected to the circuit board 250 having a controller. The FPCB 242 may be connected to the user input unit 217 of the mobile terminal. In this instance, the FPCB 242 is formed so that a signal generated from the user input unit 217 can be transmitted to the controller of the circuit board 250. For instance, the FPCB 242 is formed below the user input unit 217 so as to be connected to the user input unit 217. The FPCB 242 may be formed to contact the signal transmission unit 217*a* formed between the user input unit 217 and the FPCB 242.

One surface of the FPCB 242 contacts the user input unit 217. On another surface of the FPCB 242, contact portions 242*a*, 242*b*, 242*c* and 242*d* may be formed so as to be connected to the feeding connector (F) and the grounding connector (G) of the first antenna device (ANT 1) and the second antenna device (ANT 2), respectively.

The foregoing embodiments and advantages are merely exemplary and are not to be considered as limiting the present invention. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims. The different embodiments may also be combined.

What is claimed is:

1. A mobile terminal, comprising:

a terminal body;

a display displaying information; and an antenna device mounted in the terminal body, wherein the antenna device includes:

a first conductive member including a shape such that the antenna device resonates at a first frequency band;

a second conductive member diverging from the first conductive member, and extending by a prescribed length; and a ground member spaced apart from the second conductive member, and capacitive-coupled to the second conductive member, such that a frequency resonance added by the second conductive member is generated near a center frequency of the first frequency band, wherein the first conductive member includes a first extension portion, a second extension portion and a third extension portion, wherein the third extension portion is bent from one end of the second extension portion and formed on a different plane from the second extension portion, wherein the first extension portion and the second extension portion are spaced apart and parallel to each other, and capacitive-coupled to each other, wherein the second conductive member diverges from the one end of the second extension portion, wherein a feeding connector to which a signal is input from a substrate, and a grounding connector connected to a ground, extend from the first conductive member, and wherein ends of the first conductive member and the second conductive member are disposed on a region where the ground is not formed.

2. The mobile terminal of claim 1, wherein the first conductive member and the second conductive member are formed on a surface of a carrier having a polyhedron shape.

3. The mobile terminal of claim 2, wherein the first conductive member is bent from one surface of the carrier to extend to another neighboring surface, so as to have a length corresponding to the center frequency of the first frequency band.

4. The mobile terminal of claim 3, wherein the second conductive member extends from a part where the first conductive member is bent, toward the ground member.

5. The mobile terminal of claim 2, wherein the first conductive member is feed-connected or ground-connected to a flexible printed circuit board (FPCB) disposed below the carrier.

6. The mobile terminal of claim 5, wherein the first conductive member operates as an inverted F type antenna.

7. The mobile terminal of claim 5, wherein the FPCB is connected to a circuit board controlling the antenna device.

8. The mobile terminal of claim 7, wherein the ground member is formed below the circuit board, and wherein the ground member is formed to extend the ground.

9. The mobile terminal of claim 1, wherein the second conductive member is not disposed at a region above the ground member.

10. A mobile terminal, comprising:

a terminal body;

a display displaying information; and an antenna device mounted in the terminal body, wherein the antenna device includes:

a first conductive member having a shape such that the antenna device resonates at a first frequency;

a second conductive member diverging from the first conductive member such that the antenna device resonates at a second frequency; and a ground member capacitive-coupled to the second conductive member such that a resonance by the second conductive member is generated at a third frequency adjacent to the first frequency, wherein the first conductive member includes a first extension portion, a second extension portion and a third extension portion, wherein the third extension portion is bent from one end of the second extension portion and formed on a different plane from the second extension portion, wherein the first extension portion and the second extension portion are spaced apart and parallel to each other, and capacitive-coupled to each other, wherein the second conductive member diverges from the one end of the second extension portion, wherein a feeding connector to which a signal is input from a substrate, and a grounding connector connected to a ground, extend from the first conductive member, and wherein ends of the first conductive member and the second conductive member are disposed on a region where the ground is not formed.

11. The mobile terminal of claim 10, wherein the second conductive member and the ground member are spaced apart from each other.

12. The mobile terminal of claim 10, wherein the second conductive member is not disposed at a region above the ground member.

13. The mobile terminal of claim 10, wherein the first conductive member and the second conductive member are formed on a surface of a carrier having a polyhedron shape.

14. The mobile terminal of claim 13, wherein the antenna device is disposed at one side of the carrier, and wherein the mobile terminal further includes a sub antenna device disposed at another side of the carrier so as to operate at a frequency different from the first frequency, the second frequency and the third frequency.

15. The mobile terminal of claim 14, wherein the antenna device is formed to operate at a frequency band for providing voice service, and wherein the sub antenna device is formed to operate at a frequency band for providing data service.

16. The mobile terminal of claim 14, wherein the antenna device and the sub antenna device include conductive patterns formed on one surface of the carrier, and wherein at least parts of the conductive patterns are capacitive-coupled to each other so as to correspond to the respective frequencies with shorter lengths.

17. The mobile terminal of claim 13, wherein the first conductive member is feed-connected by the feeding connector or ground-connected by the grounding connector to a flexible printed circuit board (FPCB) disposed below the carrier.

18. The mobile terminal of claim 17, wherein the first conductive member operates as an inverted F type antenna.

* * * * *